United States Patent [19]

Sampey et al.

[11] 4,289,421

[45] Sep. 15, 1981

[54] CONCRETE ROAD PAVING ASSEMBLY

[76] Inventors: William P. Sampey; Larry A. Sampey, Sr., both of P.O. Box 2893, Morgan City, La. 70380

[21] Appl. No.: 47,341

[22] Filed: Jun. 11, 1979

[51] Int. Cl.[3] ..... E01C 19/12

[52] U.S. Cl. ..... 404/106; 404/119

[58] Field of Search ..... 404/105, 118, 119, 120, 404/101, 114; 172/780

[56] References Cited

U.S. PATENT DOCUMENTS

| | | | |
|---|---|---|---|
| 1,678,624 | 7/1928 | Carr | 404/119 |
| 2,065,698 | 12/1936 | Heltzel | 404/101 |
| 2,303,336 | 12/1942 | Day | 404/114 |
| 2,866,394 | 12/1958 | Smith | 404/119 |
| 3,164,072 | 1/1965 | Blankenship | 404/96 |
| 3,251,281 | 5/1966 | Iannetti | 404/120 |
| 3,377,933 | 4/1968 | Dale | 404/119 X |
| 3,421,418 | 1/1969 | Hudis | 404/105 |
| 3,738,763 | 6/1973 | Glesmann | 404/119 |

*Primary Examiner*—Nile C. Byers, Jr.

*Attorney, Agent, or Firm*—Roy, Kiesel, Patterson & McKay

[57] ABSTRACT

An assembly for paving concrete roads and other similar areas is disclosed having a width adjustable screed attached to a lightweight frame structure and utilizing mechanical vibrators in conjunction with a crown-shape finishing pan to produce a finished concrete road.

2 Claims, 7 Drawing Figures

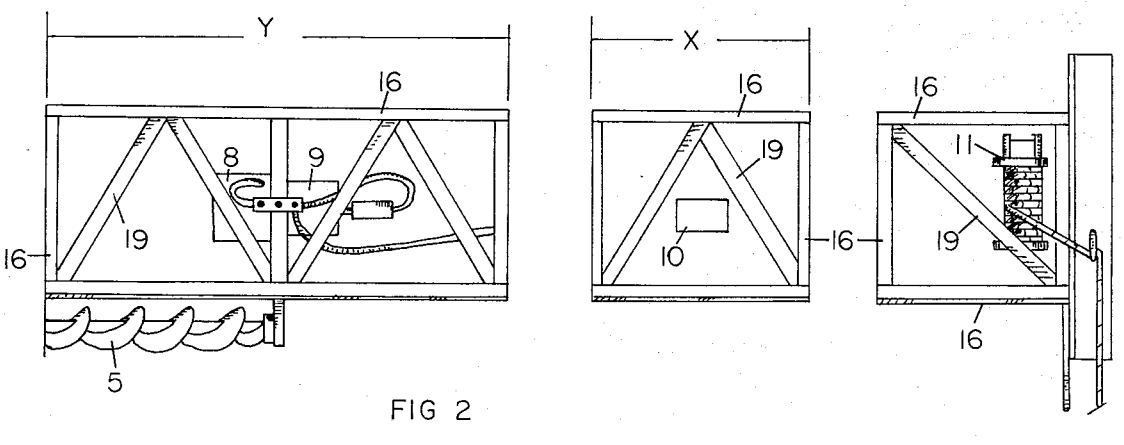
FIG 2
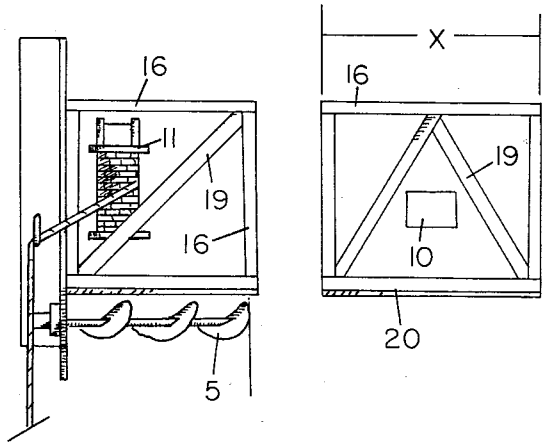
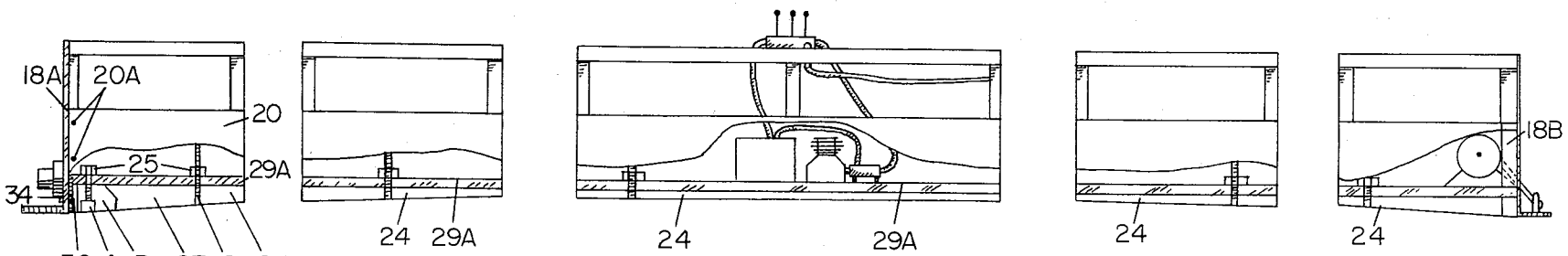
FIG 3
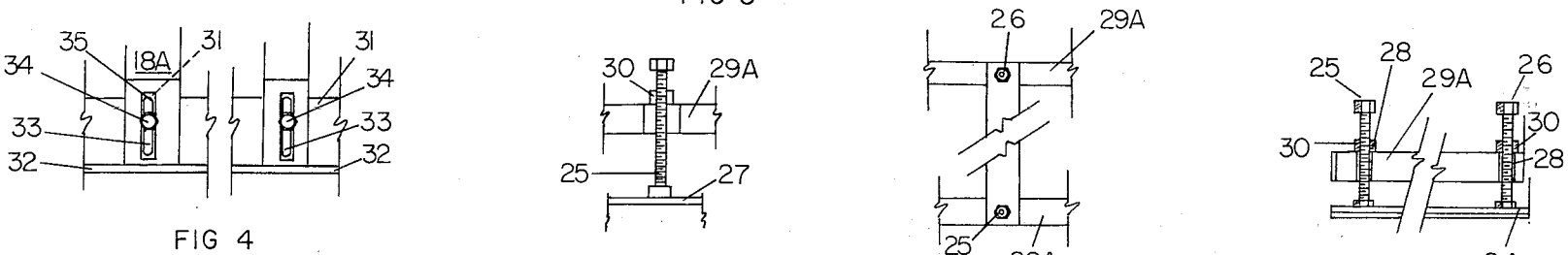
FIG 7
FIG 6
FIG 5
FIG 4

CONCRETE ROAD PAVING ASSEMBLY

BACKGROUND OF THE INVENTION

1. Field of the Invention

This invention relates broadly to apparatus for making pavement for roads and, more particularly, to width adjustable screeds.

2. Prior Art

One of the difficulties facing highway contractors has been the non-existence of road paving apparatus that are simple in construction and which have the capability of being easily width adjusted. Another problem with present paving apparatus is that they are too heavy and cannot operate on less firm soils without difficulty. Exemplary of the present art are those screed designs disclosed in—Heltzel U.S. Pat. No. 1,741,459, issued Dec. 31, 1979, and entitled "Road Screed;" Barber U.S. Pat. No. 216,850, issued Aug. 8, 1939, and entitled "Propelling and Finishing Units;" Heltzel U.S. Pat. No. 2,235,105, issued Mar. 18, 1941. and entitled "Adjustable Screed;" Millikin et al U.S. Pat. No. 2,299,700, issued Oct. 20, 1942, and entitled "Screed Unit;" Beeson U.S. Pat. No. 2,990,754, issued July 4, 1961, and entitled "Quick-Crown-Change Surfacing Unit;" Blankenship et al U.S. Pat. No. 3,164,072, issued Jan. 5, 1965, and entitled "Concrete Finishing Apparatus;" and an advertising brochure by Pav-Saver Manufacturing Co., 1103 14th Avenue, East Moline, Ill., entitled "PAV-SAVER".

SUMMARY OF THE INVENTION

Therefore, one object of this invention is to provide a lightweight paving apparatus.

Another object of this invention is to provide a screed that is easily width adjusted.

Other advantages and objects of this invention shall become apparent from the ensuing descriptions of the invention.

Accordingly, a lighweight paving assembly is provided comprising a frame structure having upper frame members separated from lower frame members by vertical frame members, a screed assembly having a frontal strike-off plate attached parallel to the front side of the frame structure and a finishing pan attached to the bottom side of the frame structure, an auger attached in front of the strike-off pan to feed wet concrete below the finishing pan, skid guide units attached to the end of the road forms, winches attached to the frame structure and connectable thereto by cables to pull the paving assembly on the forms, and hydraulic vibrators attached to the finishing pan to impact a vibrating motion to the finishing pan.

BRIEF DESCRIPTION OF THE DRAWINGS

FIG. 2 is a top perspective view of a preferred embodiment of this invention.

FIG. 3 is a perspective view illustrating the adjustable screed.

FIGS. 4–7 are detail figures of the screed pan adjustment assembly.

PREFERRED EMBODIMENTS OF THE INVENTION

Figure 1:
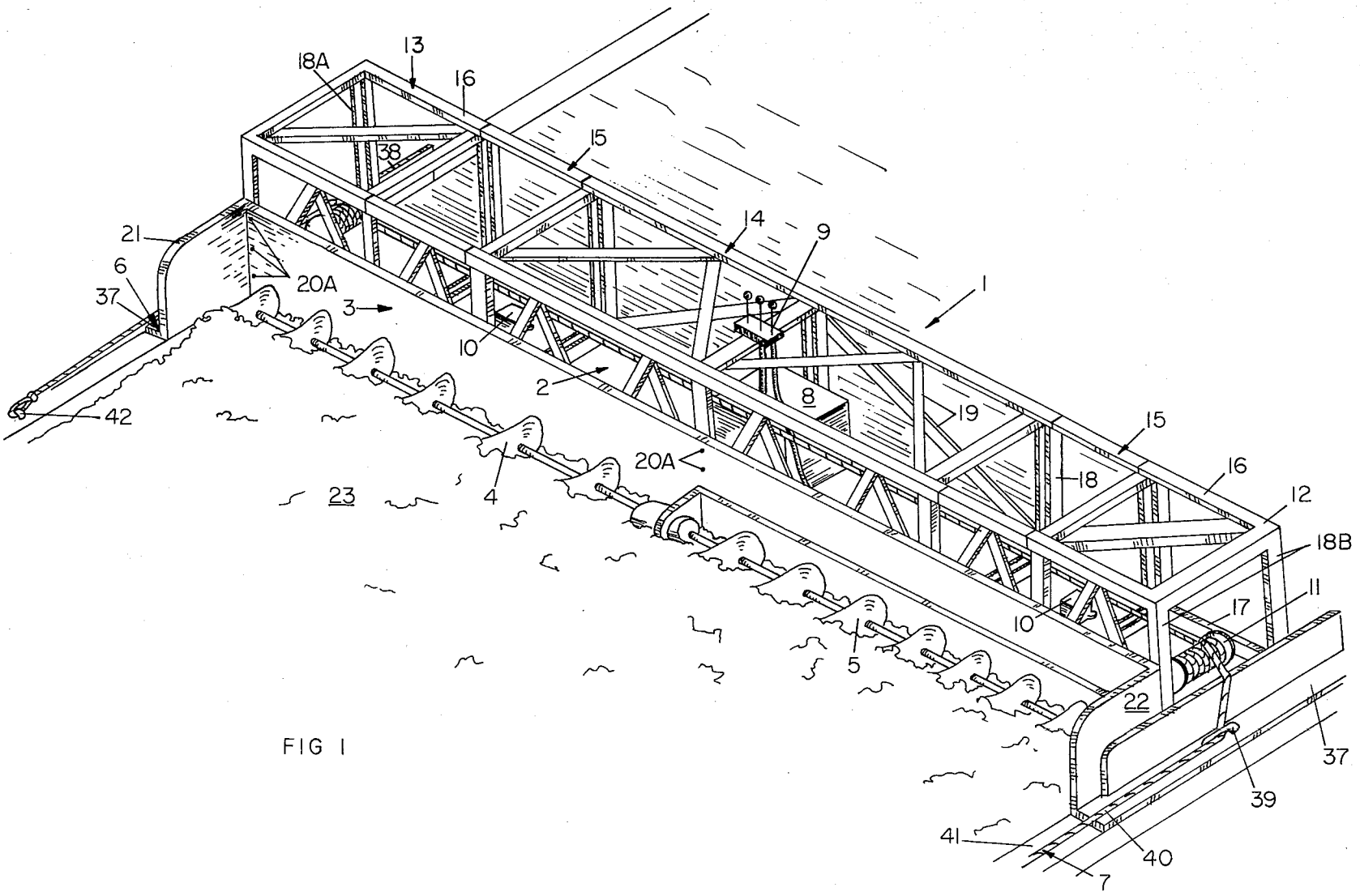
FIG. 1 is a perspective view of a preferred embodiment of this invention.

As seen in FIG. 1, the paving assembly comprises broadly a lightweight frame structure 1 to which is attached a vibrating finishing pan 2, screed 3 having augers 4 and 5 connected in front thereof, skid guide units 6 and 7, and the necessary motors 8 and controls 9 to run the vibrators 10 and winches 11.

Frame structure 1 is constructed from channel iron pieces either as a single unit or preferably as attachable units as shown. In the unitized embodiment there will be two end units 12 and 13 on which the travel winches are attached, a center unit 14 on which are mounted the motors 8 and controls 9, and a number of extension units 15 to produce the desired length of frame structure. The channel iron design structure can vary but each design must result in a rigid lightweight frame structure 1. A preferred design is illustrated wherein the top frame channel iron members 16 are separated from the lower frame channel iron members 17 by vertical channel iron members 18 and cross support channel iron members 19. In this embodiment, multiple modular structure units can be added to achieve the desired structure width.

Attached to the front of frame structure 1 is screed frontal strike-off plate 20 that extends completely across the front of frame structure 1. Perpendicularly attahced to each end of plate 20 are side plates 21 and 22 which, with frontal plate 20, form a retaining pen where wet concrete 23 is to be poured. In the unitized structure disclosed, plate 20 should be removably attached, such as by bolts 20A, to allow for different width plates to be attached as additional frame stucture units are added.

To the bottom of frame structure 1 is attached an adjustable screed finishing pan 24 (See FIG. 3) which shapes the concrete into the desired crown. To adjust the shape finising pan 24 two rows of threaded bolts 25 and 26 are fixedly attached to pan surface 27 and pass through openings 28 in a channel irons 29A and 29B, respectively, that extends above pan 24 and is attached at each end to vertical channel iron members 18A and 18B. Nuts 30 are then screwed down on each bolt 25 or 26 until they contact channel iron 29A and 29B, respectively. If they are screwed down furher, pan 24 will be forced upward. In this manner, pan 24 can be shaped as desired.

Pan 24 is also provided as shown in FIG. 4 with side plates 31 perpendicularly attached to the outside edges 32 of pan 24. Plates 31 are provided with vertical slots 33 through which tightening bolts 34 can pass. Similarly, vertical channel iron members 18A and 18B are provided with corresponding slots 35 so that when nuts 36 are tightened on bolts 34 pan edge 32 is rigidly fixed.

In a preferred feature, vibrators 10 are positioned on top of pan 24 to impart a vibrating motion to the pan to remove voids and obtain a smooth finish to the pavement. A preferred vibrator that can be used is a hydraulic vibrator which allows not only a lighter weight unit to be used, but which allows for a very satisfactory crown to be formed in the concrete while using a smaller, lighter vibrator. The size and number of vibrators will depend upon the width of the finishing pan as well as the finishing specifications for the road. Since these may vary from job to job, it is preferred that the vibrators be removably attachable to the finishing pan.

In still another preferred embodiment, skid guide units 6 and 7 are constructed from a flat metal plate 37 and a strengthening plate 38 attached perpendicularly to vertical channel iron members 18A and 18B as shown in FIG. 1. On top of plate 37 is winch cable guide 39 through which winch cable 40 passes.

With the combination of frame structure 1, screed 3 and vibrating units 10, applicant has been able to produce a paving assembly having a weight of one-third to one-fourth of that of present paving assemblies. The benefits of this weight reduction are enormous: the machine can be used on less firm soils, small motors are required to operate the machine, it is easier to manipulate, position and operate the machine, as well as substantial reduction in cost to manufacturer.

To operate the paving machine, it is first placed on forms 41 which define the area to be paved. Winch cables 40 are then attached to hooks 42 attached to forms 41. Pan 24 is then adjusted to produce the desired crown. Augers 5, preferably a split-type auger, are rotated by conventional drive means (not shown) connected to motors 8. Hydraulic vibrators 10 are then turned on. Wet concrete 23 is then poured in front of augers 5 which then feeds the wet concrete under pan 24 which shapes the concrete into the desired crown with the help of vibrators 10 that compact the slab, as well as, eliminates voids and raises fines for finising. The paving machine is then pulled along forms 41 by winches 11 reeling in winch cables 40.

There are, of course, many obvious alternate embodiments not shown but which are included with the scope of this invention as defined by the following claims.

What we claim is:

1. A lightweight paving machine comprising:

(a) a frame structure comprising multiple modular units ridgedly attached to one another wherein each modular unit comprises upper frame members separated from lower members by vertical frame members attached at their opposite ends to said upper frame member and lower frame members, respectively, said vertical frame members of adjacent modular units being attached to one another;

(b) a screed assembly comprising a frontal strike-off plate attached parallel to a front side of said frame structure and a finishing pan attached to the bottom side of said frame structure, said finishing pan comprising an adjusting assembly to adjust the crown shape formed by said finishing pan, said adjusting assembly comprising a metal bar extending from one end of said frame structure to its other end, said metal bar being positioned above said pan, two rows of threaded bolts attached at one bolt end to said pan and its opposite end passing through openings in said metal bar, one nut screwed into each of said bolts to pull said pan in a desired position, said pan being vertically adjustable on said frame structure at said pan's opposite ends;

(c) an auger attached parallel to said screed assembly and positioned in front of said frontal strike-off plate;

(d) skid guide units attached to each end of said frame structure, each comprising a flat metal plate positioned perpendicularly to said frame structure end and parallel with bottom side of said frame structure;

(e) winches attached to said frame structure; and (f) vibrators attached to said finishing pan to impart a vibrating motion to said finishing pan.

2. A lightweight paving machine according to claim 1 wherein said vibrators are hydraulic vibrators.

* * * * *